United States Patent [19]

Miller

[11] 4,372,146

[45] Feb. 8, 1983

[54] PRESS MOTION DAMPENER

[75] Inventor: Donald E. Miller, Mt. Prospect, Ill.

[73] Assignee: The Continental Group, Inc., Stamford, Conn.

[21] Appl. No.: 206,194

[22] Filed: Nov. 12, 1980

[51] Int. Cl.[3] ..... B21D 22/10

[52] U.S. Cl. ..... 72/453.13; 72/351; 267/119

[58] Field of Search ..... 72/453.13, 453.01, 453.18, 72/453.08, 354, 352, 353, 358, 351; 267/119, 130; 188/129

[56] References Cited

U.S. PATENT DOCUMENTS

| | | | |
|---|---|---|---|
| 1,926,012 | 9/1933 | Ferris | 72/351 |
| 3,077,344 | 2/1963 | Williamson | 267/119 |
| 4,125,010 | 11/1978 | Adam | 72/453.08 |
| 4,206,628 | 6/1980 | Miller | 72/453.18 |
| 4,210,013 | 7/1980 | Miller | 72/358 |
| 4,212,185 | 7/1980 | Miller | 72/453.18 |
| 4,233,872 | 11/1980 | Schulze | 267/119 |
| 4,311,086 | 1/1982 | Schoen | 267/119 |

FOREIGN PATENT DOCUMENTS

| | | | |
|---|---|---|---|
| 754232 | 8/1956 | United Kingdom | 72/351 |

*Primary Examiner*—Gene Crosby
*Attorney, Agent, or Firm*—Charles E. Brown

[57] ABSTRACT

This disclosure relates to a dampener particularly adapted to be connected to a load beam of a forming press wherein at an initial forming stage there is to be a higher than normal resistance to movement of the load beam. The dampener includes suitable lever arrangements which are coupled to fluid motors which resist the movement of the lever arrangements. The lever arrangements are actuated by a cam member carried by a movable press component which is coupled to the supporting pad of the press tooling.

9 Claims, 5 Drawing Figures

PRESS MOTION DAMPENER

This invention relates in general to new and useful improvements in press constructions, and more specifically to a dampener to be utilized in conjunction with a movable press component for initially dampening or restricting the movement thereof.

The invention particularly relates to a press wherein a tubular member is formed in a fixed die sleeve with the material being worked being seated on a pad which is driven through the die sleeve by a punch in the operation of the press. The pad may be suitably restrained against movement, but preferably is connected to the punch so as to draw the punch down as the thickness of the material which is being formed decreases. Most specifically, the pad is carried by a load beam mounted for limited movement.

In the operation of the press there is an initial impact extrusion of the workpiece and at the time of the initial impact it is desirable under certain circumstances to restrict the downward movement of the pad and load beam. To this end there is provided a dampener in accordance with this invention.

The dampener is preferably of a simple construction and includes a cam member which is movable between two sets of linkages with each set of linkages including a fluid motor which resists the movement of the linkages and wherein the resistance of the fluid motor may be controlled by the pressure of the fluid supplied thereto.

Basically, the dampener includes a reciprocating cam member which has two oppositely facing remote cam surfaces which are engageable with cam followers for the purpose of pivoting a pair of levers which, in turn, pivot other levers in the form of actuators. The actuators are, in turn, connected to piston rods of a pair of opposed fluid motors, preferably air motors.

The air motors are connected to a source of air under pressure and the resistance to movement of the cam member may be controlled by controlling the air pressure. After the initial operation of the dampener, the air pressure in the air motors may be relieved or reduced so as to prevent any drag on the movement of the cam member.

With the above and other objects in view that will hereinafter appear, the nature of the invention will be more clearly understood by reference to the following detailed description, the appended claims, and the several views illustrated in the accompanying drawings.

Figure 1:
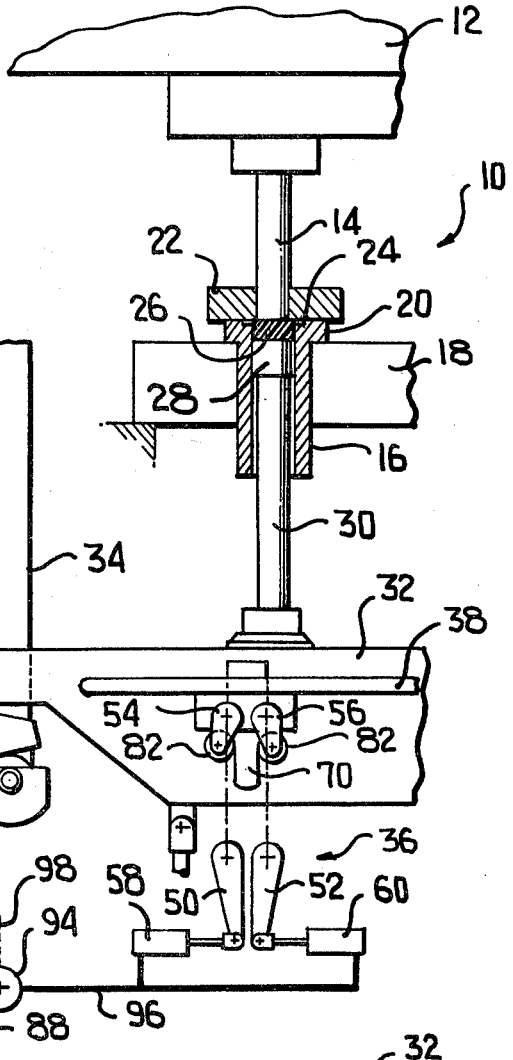
FIG. 1 is a schematic elevational view showing a press structure incorporating the dampener.

Referring now to the drawings in detail, it will be seen that there is illustrated in FIG. 1 a press which is generally identified by the numeral 10. The press 10 includes a vertically reciprocating ram 12 which is driven by a crank mechanism (not shown). The ram 12 suitable tooling including a punch 14 which is movable through a die sleeve 16 fixedly mounted in a frame part 18 for forming a tubular member. Most specifically, the tooling of the press 10 is intended to form a container with an integral upper flange and an integral closed bottom. To this end the tooling includes the die sleeve 16 having an enlarged upper portion 20 which defines, in combination with a flange clamp 22, a flange forming recess 24.

A puck or pad 26 of the material to be formed is initially positioned in the upper part of the die sleeve 16 resting upon a supporting pad 28.

In the specific press illustrated in FIG. 1, the pad 28 is carried by a support 30 which, in turn, is carried by a load beam 32. The load beam 32 is free to move downwardly in response to the application of a load to the pad 28. In the illustrated press structure, a coupling mechanism 34 (not forming a part of this invention) couples the load beam 32 to the ram 12 for drawing the ram 12 down at a faster rate than the movement of the load beam 32 during the press operation.

While the above described components of the press 10 provide for an operable structure, it is desired that in order to obtain the necessary extrusion of the material being formed into the flange forming recess 24, initially the downward movement of the load beam 32 should be retarded to a greater extent than that which will be provided for by the connection coupling mechanism 34. For this purpose there is provided a dampener formed in accordance with this invention, the dampener being generally identified by the numeral 36. The dampener 36 serves to apply a resistive force against the initial downward movement of the load beam 32, which restrictive force is removed after the preselected travel of the load beam.

Figure 2:
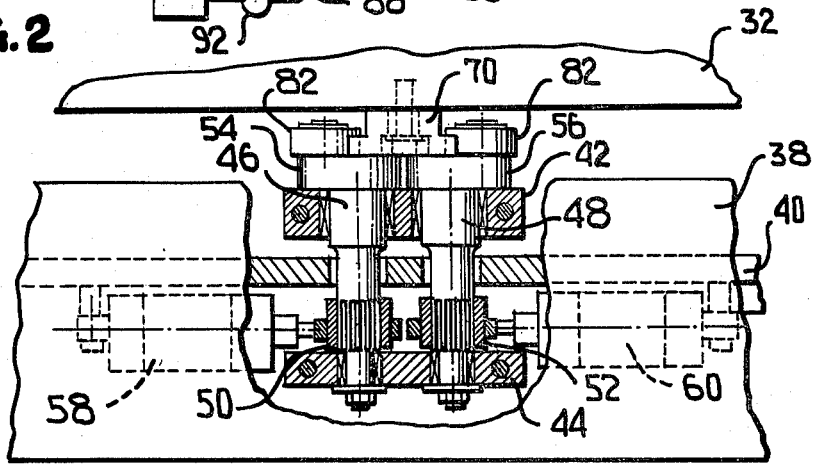
FIG. 2 is a horizontal sectional view taken through the press above the load beam, with parts broken away and shown in section.
Figure 5:
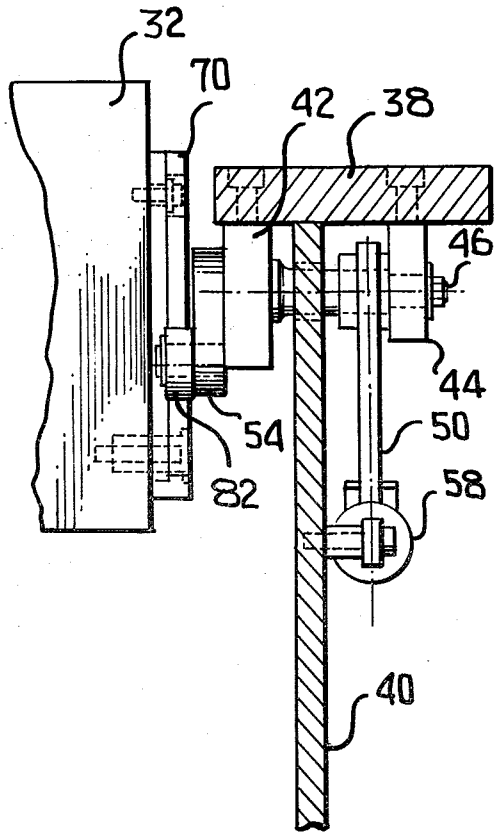
FIG. 5 is a fragmentary transverse vertical sectional view taken generally along the line 5—5 of FIG. 3, and shows specifically the mounting of the various components of the dampener.

Referring to FIGS. 2 and 5 in particular, it will be seen that disposed adjacent one side of the load beam 32 is a frame structure which includes a horizontal plate 38 which is supported by a vertical plate 40. A pair of support plates 42 and 44 are secured to the underside of the plate 38 on opposite sides of the plate 40. The plates 42, 44 carry suitable bearings and have journalled therein shafts 46, 48. The shafts 46, 48 are thus mounted with respect to the frame of the press 10 for oscillation or rotation about their axes.

Between the plate 40 and the plate 42 the shafts 46, 48 have fixedly secured therein a pair of lever arms or actuating arms 50, 52, respectively. Between the plate 42 and the load beam 32, the shafts 46, 48 have fixedly secured thereon lever arms 54, 56, respectively. Thus, the arms 50 and 54 are fixedly coupled to one another for movement in unison. In a like manner, the arms 52 and 56 are coupled together for movement in unison.

The plate 40 has mounted thereon a pair of fluid motors 58, 60 which are of the linear responsive type and which have pistons (not shown) and piston rods 62 and 64, respectively. The piston rods 62, 64 oppose one another and are pivotally connected to the lower ends of the actuating arms 50, 52, respectively, by pivotal connections 66, 68.

The load beam 32 has secured to the face thereof a vertically extending cam member 70. The mounting of the cam member 70 is best shown in FIG. 5.

Figure 4:
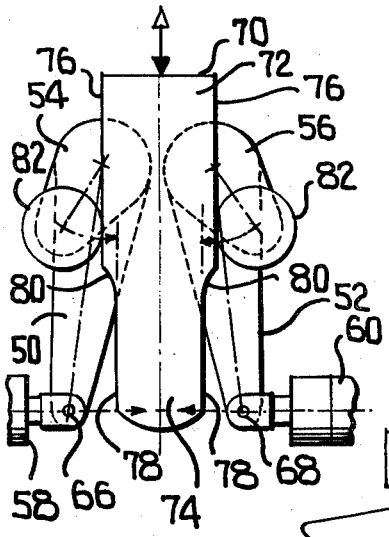
FIG. 4 is an enlarged fragmentary schematic view showing the dampener in its fully actuated position.

As is best shown in FIG. 4, the cam member 70 has a relatively wide upper portion 72 and a narrow lower portion 74. The upper portion 72 is defined at the side edges thereof by straight surfaces 76 while the lower portion 74 is defined at the opposite sides thereof by straight portions 78. Each pair of straight portions 76 and 78 is connected by a curved or camming surface 80. Thus, at each side of the cam member 70 is a cam surface which is first straight and parallel to the direction of movement of the cam member, than curved to provide a camming action, and last straight and parallel to the direction of movement of the cam member.

The lever arms 54 and 56 carry cam followers 82 which engage the cam surfaces of the cam 70.

The fluid motors 58, 60 are preferably in the form of air motors and are coupled to a source of compressed air, the source being identified by the numeral 84. The source 84 has extending therefrom two supply lines 86, 88, each of which has mounted therein a suitably pressure varying valve 90, 92, respectively. The lines 86, 88 are connected to a control valve 94 from which there leads a supply line 96 coupled to the fluid motors 58, 60. The valve 94 is provided with a suitable actuator 98.

OPERATION

In accordance with this invention, at the time the punch 14 approaches the puck 26, the valve 94 is actuated to couple the supply line 96 to the compressed air source 84 through the supply line 88 which supplies air at a controlled relatively high pressure. As the cam member 70 moves downwardly with the load beam 32, the cam followers 82, which are seated against the arcuate cam surfaces 80, are moved apart, thus pivoting the actuating arms 50, 52 so as to move the lower ends thereof apart as is generally shown in FIG. 4. This movement of the actuating arms 50, 52 is resisted by the relatively high air pressure in the fluid motors 58, 60, and thus there is an initial resistance to the downward movement of the load beam 32.

After the extrusion of the material of the puck 26 to form the flange of the container has been completed, there is no further need for the dampener 36. Accordingly, after the cam followers 82 have ridden onto the flat cam surfaces 76, the valve 94 may be actuated so as to supply air under a much reduced pressure to the fluid motors 58, 60. This serves to hold the cam followers 82 only lightly against the surfaces 76 and produces very little if any resistance to the continued movement of the cam member 70 while at the same time maintaining the cam followers 82 against the cam member at all times.

It is to be understood that after the article forming structure has been completed, the ram 12 and the punch 14 will move upwardly, leaving the formed member within the die sleeve 16. The load beam 32 will then be moved upwardly with the pad 28 pushing the newly formed article out of the die sleeve. As the cam member 70 moves vertically, the cam followers 82 will ride down the cam surfaces but will be maintained in contact with the cam member 70 at all times due to the light pressure within the air motors 58, 60.

Figure 3:
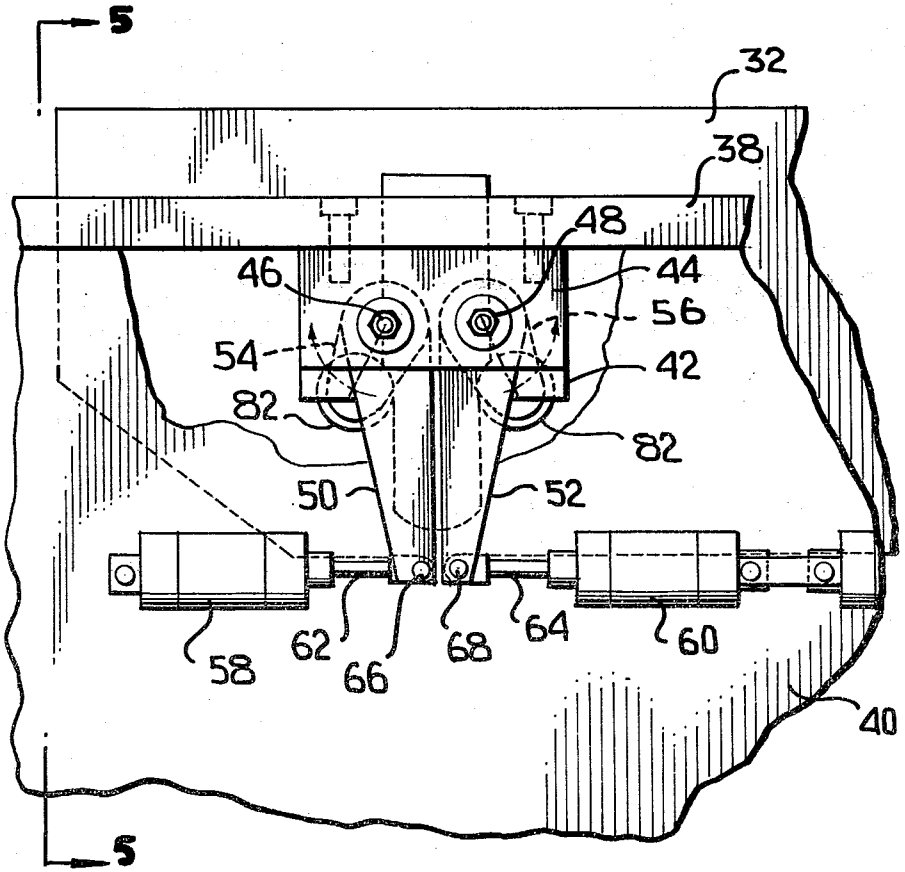
FIG. 3 is an enlarged fragmentary front elevational view of the load beam and dampener.

It is to be understood that the cam member 70 remains between the cam followers 82 at all times. While the position of the cam member 70 with respect to the cam followers 82 at the initial point of operation of the press 10 is with the cam followers 82 seated on the cam surfaces 80, it is to be understood that in order to eject a formed article from the die sleeve 16 it is necessary that the pad 28 be moved up to the top of the die sleeve. Thus, the cam member 70 will be moved vertically beyond the starting position shown in FIG. 3, thus requiring the straight lower portion 74 on the cam member 70.

While only one set of tooling has been illustrated, it is to be understood that the press 10 may incorporate at least one other set of tooling. Further, while only one dampener 36 has been illustrated, it is to be understood that there should be at least two dampeners 36 on each side of the load beam 32, thus making a total of at least four dampeners 36.

With respect to the operation of the control valve 94, it is to be understood that the press 10 will be provided with conventional control mechanisms which may suitably actuate the control valve 94 in any conventional manner.

Although only a preferred embodiment of the invention has been specifically illustrated and described herein, it is to be understood that minor variations may be made in the construction of the dampener without departing from the spirit and scope of the invention as defined by the appended claims.

I claim:

1. In a damper for dampening the travel of a moving member, said dampener comprising a pair of fluid motors having opposed operating elements, an actuating arm coupled to each of said operating elements, a reciprocating cam member operatively connected to said moving member, and means cooperative with said cam member for simultaneously moving said actuating arms in opposite directions against the resistance of said fluid motors, said cam member having remote oppositely facing surfaces including cam surfaces, and said means cooperative with said cam member being a pair of opposed cam followers engageable with said oppositely facing surfaces, said oppositely facing surfaces including cam follower engageable surfaces which are parallel and are after said cam surfaces in the direction of travel of said cam member.

2. A dampener according to claim 1 wherein said oppositely facing surfaces also include cam follower engageable surfaces which are parallel and are before said cam surfaces in the direction of travel of said cam member.

3. A dampener as defined in claim 1 wherein said dampener is a press dampener, and said cam member is carried by a reaction member of a press.

4. In a dampener for dampening the travel of a moving member, said dampener comprising a pair of fluid motors having opposed operating elements, an actuating arm coupled to each of said operating elements, a reciprocating cam member operatively connected to said moving member, and means cooperative with said cam member for simultaneously moving said actuating arms in opposite directions against the resistance of said fluid motors, each actuating arm being carried by a pivot shaft mounted for rotation about a fixed axis, said cam member having remote oppositely facing surfaces including cam surfaces, said means cooperative with said cam member being a pair of opposed cam followers engageable with said oppositely facing surfaces, and a lever carried by each pivot shaft and carrying one of said cam followers.

5. In a dampener for dampening the travel of a moving member, said dampener comprising a pair of fluid motors having opposed operating elements, an actuating arm coupled to each of said operating elements, a reciprocating cam member operatively connected to said moving member, and means cooperative with said cam member for simultaneously moving said actuating arms in opposite directions against the resistance of said fluid motors, fluid pressure means for controlling the pressure of fluid in said fluid motors, said fluid pressure means including two different fluid sources of different pressures and valve means for selectively connecting said fluid motors to said fluid sources.

6. A dampener for dampening the travel of a moving member, said dampener comprising a pair of fluid motors having opposed operating elements, an actuating arm coupled to each of said operating elements, a reciprocating cam member, and means cooperative with said cam member for simultaneously moving said actuating arms in opposite directions against the resistance of said fluid motors, said dampener being a press dampener, and said cam member being coupled to a die pad of a press tooling for pressure forming a material puck into a workpiece.

7. A press dampener as defined in claim 6 wherein said press tooling is of the type wherein a maximum resistance to movement of said die pad is required during a preselected portion only of the operation of said press.

8. A press dampener according to claim 7 together with fluid pressure means for controlling the pressure of fluid in said fluid motors during said press operation preselected portion.

9. A press dampener according to claim 7 together with fluid pressure means for controlling the pressure of fluid in said fluid motors during said press operation preselected portion, said fluid pressure means including two different fluid sources of different pressures and valve means for selectively connecting said fluid motors to said fluid sources.

* * * * *